US007076421B2

(12) United States Patent
Murgia et al.

(10) Patent No.: US 7,076,421 B2
(45) Date of Patent: Jul. 11, 2006

(54) METHOD AND SYSTEM FOR SUPPORTING INCREASED CHANNEL DENSITY

(75) Inventors: Carlo Murgia, Aliso Viejo, CA (US); Jeffrey D. Klein, Irvine, CA (US); Huan-Yu Su, San Clemente, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 0 days.

(21) Appl. No.: 11/077,809

(22) Filed: Mar. 9, 2005

(65) Prior Publication Data

US 2005/0220133 A1 Oct. 6, 2005

Related U.S. Application Data

(62) Division of application No. 10/464,307, filed on Jun. 17, 2003, now Pat. No. 6,873,956.

(51) Int. Cl.
*G10L 21/02* (2006.01)

(52) U.S. Cl. ..... 704/200; 704/270; 370/646

(58) Field of Classification Search ..... None
See application file for complete search history.

(56) References Cited

U.S. PATENT DOCUMENTS

| | | | | |
|---|---|---|---|---|
| 5,255,343 | A * | 10/1993 | Su | 704/242 |
| 5,363,451 | A * | 11/1994 | Martinez et al. | 381/71.13 |
| 5,563,895 | A * | 10/1996 | Malkamaki et al. | 714/748 |
| 5,648,967 | A * | 7/1997 | Schulz | 370/328 |
| 6,789,058 | B1 * | 9/2004 | Shlomot et al. | 704/201 |
| 6,873,956 | B1 * | 3/2005 | Murgia et al. | 704/504 |

* cited by examiner

*Primary Examiner*—Abul K. Azad
(74) *Attorney, Agent, or Firm*—Farjami & Farjami LLP

(57) ABSTRACT

An exemplary multi-channel speech processor comprises a controller capable of interfacing with a plurality of channels, and at least one signal processing unit (SPU) coupled to the controller, where the multi-channel speech processor has a maximum execution time for processing all frames, one channel at a time, by processing a single frame from each of the plurality of channels. The signal processing unit encodes each of the single frames from each of the plurality of channels, one channel at a time, to generate encoded frames until the maximum execution time elapses or is about to elapse. The controller also transmits a predetermined frame for each of the plurality of channels not processed during the encoding step, due to the maximum execution time elapsing or being about to elapse, such that the predetermined frame causes a decoder which receives the predetermined frame to generate a frame erase frame.

18 Claims, 6 Drawing Sheets

METHOD AND SYSTEM FOR SUPPORTING INCREASED CHANNEL DENSITY

This application is a divisional of U.S. patent application Ser. No. 10/464,307, filed Jun. 17, 2003 now U.S. Pat. No. 6,873,956.

BACKGROUND OF THE INVENTION

1. Field of the Invention

The present invention relates generally to speech and audio signal processing. More particularly, the present invention relates to multiple channel speech and audio signal processing.

2. Related Art

In a conventional voice-over-packet ("VoP") system or voice over IP ("VoIP") system, telephone conversations or analog voice may be transported over the local loop or the public switched telephone network ("PSTN") to the central office ("CO"), where speech is digitized according to an existing protocol, such as G.711. From the CO, the digitized speech is transported to a gateway device at the edge of the packet-based network. The gateway device receives the digital speech and packetizes it. The gateway device can combine G.711 samples into a packet, or use any other compressing scheme. Next, the packetized data is transmitted over the packet network, such as the Internet, for reception by a remote gateway device and conversion back to analog voice in the reverse manner as described above.

For purposes of this application, the terms "speech coder" or "speech processor" will generally be used to describe the operation of a device that is capable of encoding speech for transmission over a packet-based network and/or decoding encoded speech received over the packet-based network. As noted above, the speech coder or speech processor may be implemented in a gateway device for conversion of speech samples into a packetized form that can be transmitted over a packet network and/or conversion of the packetized speech into speech samples.

A speech processor can be configured to handle the speech coding of multiple channels. Thus, input speech signal frames from multiple channels can be processed by the speech processor. With variable-rate codecs (coder-decoder), input speech signal frames are typically processed by adapting the bit-rate to the amount of information carried by the input speech signal frame, and may include a single-rate codec that uses discontinuous transmission ("DTX"). This variable bit-rate is associated with a variable processing complexity or coding algorithm complexity. In general, different bit-rates vary in complexity. Increased complexity corresponds to increased processing requirements. Conventional speech processors, however, inefficiently allocate its processing power. For example, in order to safeguard against exceeding their available computation power, conventional speech processors support a maximum channel density according to a worst-case definition, e.g., by assuming that the input speech signal frame for each channel will be processed with the highest complexity. As a consequence of this inefficient allocation of processing power, the price per port of such speech processors are significantly increased, which is undesirable.

Accordingly, there is a strong need in the art for a signal processing apparatus and method which provides efficient allocation of speech processing power.

SUMMARY OF THE INVENTION

In accordance with the purposes of the present invention as broadly described herein, there is provided a multi-channel speech processor and method with increased channel density. The present invention resolves the need in the art for a signal processing apparatus and method which provides efficient allocation of speech processing power.

In one exemplary embodiment of the present invention, a multi-channel speech processor comprises a controller capable of interfacing with a plurality of channels, a memory coupled to the controller configured to store speech signal process time values, and at least one signal processing unit coupled to the controller. Typically, the multi-channel speech processor supports a plurality of bit-rates and has a maximum execution time for processing all frames, one channel at a time, by processing a single frame from each of the plurality of channels.

In accordance with the invention, the signal processing unit is configured to encode each of the single frames from each of the plurality of channels, one channel at a time, to generate encoded frames until the maximum execution time elapses or is about to elapse. The encoded frames are then transmitted by the controller. The controller is further configured to transmit a pre-determined frame for each of the plurality of channels not processed during the encoding step, due to the maximum execution time elapsing or being about to elapse, such that the predetermined frame causes a decoder which receives the predetermined frame to generate a frame erase frame.

The predetermined frame may, for example, be a frame erase packet, an illegal packet or a blank frame, such that the predetermined frame is processed as a frame erasure by the decoder upon receipt.

These and other aspects of the present invention will become apparent with further reference to the drawings and specification, which follow. It is intended that all such additional systems, methods, features and advantages be included within this description, be within the scope of the present invention, and be protected by the accompanying claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

The present invention may be described herein in terms of functional block components and various processing steps. It should be appreciated that such functional blocks may be realized by any number of hardware components and/or software components configured to perform the specified functions. For example, the present invention may employ various integrated circuit components, e.g., memory elements, digital signal processing elements, logic elements, and the like, which may carry out a variety of functions under the control of one or more microprocessors or other control devices. Further, it should be noted that the present invention may employ any number of conventional techniques for data transmission, signaling, signal processing and conditioning, speech coding and decoding and the like. Such general techniques that may be known to those skilled in the art are not described in detail herein.

It should be appreciated that the particular implementations shown and described herein are merely exemplary and are not intended to limit the scope of the present invention in any way. For example, the present invention may be implemented in a number of communication systems arrangements, including wired and/or wireless system arrangements. For the sake of brevity, conventional data transmission, speech encoding, speech decoding, signaling and signal processing and other functional aspects of the data communication system (and components of the individual operating components of the system) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical communication system.

Figure 1:
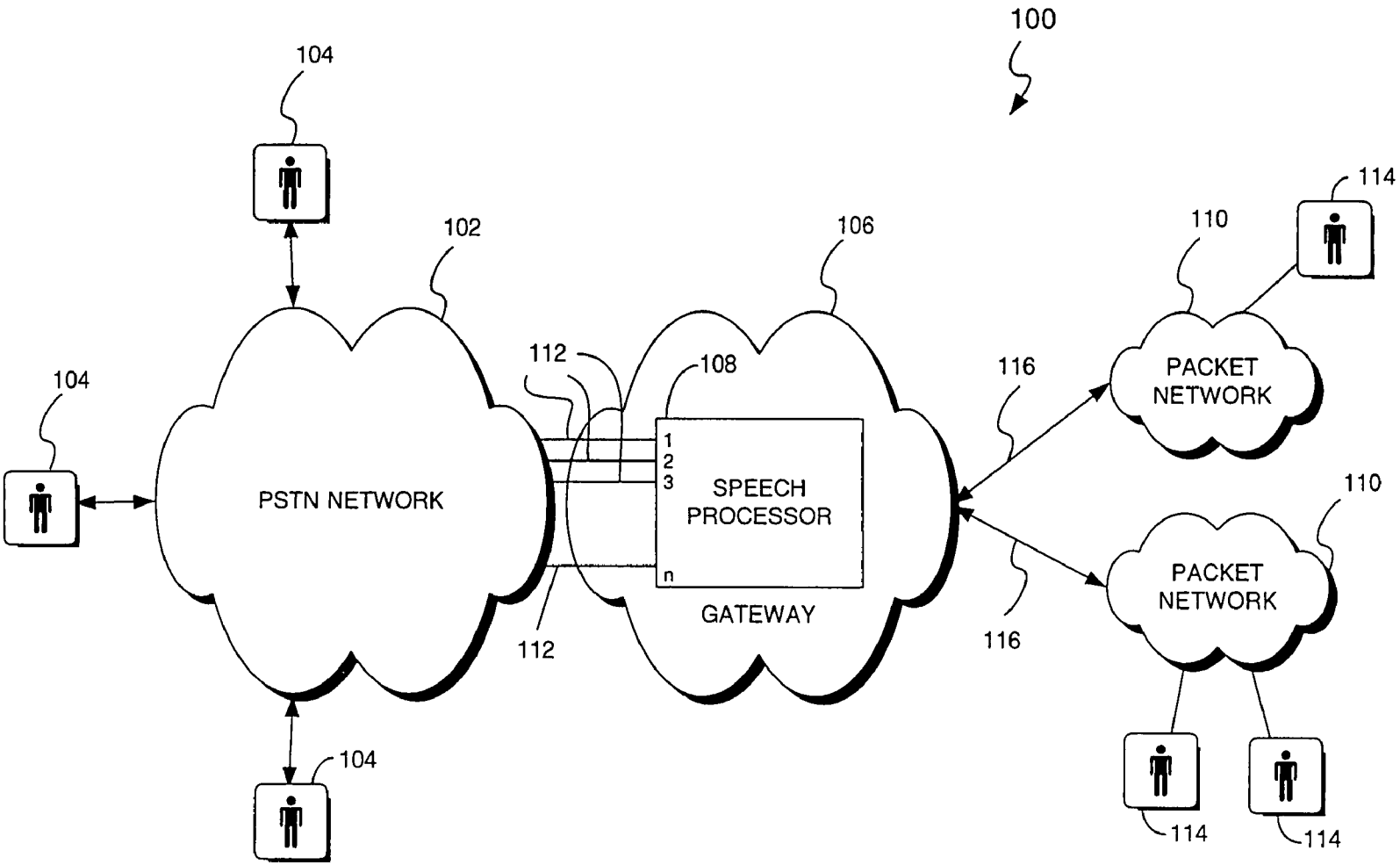
FIG. 1 illustrates a block diagram of a packet-based network in which various aspects of the present invention may be implemented.

FIG. 1 depicts an illustrative communication environment 100 that is capable of supporting the transmission of packetized voice information over transmission medium 116. Packet networks 110, such as those conforming to the Internet Protocol ("IP"), may support Internet telephony applications that enable a number of participants 104, 114 to conduct voice communication in accordance with VoP techniques. Network 102, which may be a non-packet network, such as switched network, or PSTN, supports telephone conversations between participants 104. In practical environment 100, network 102 may communicate with conventional telephone networks, local area networks, wide area networks, public branch exchanges, and/or home networks in a manner that enables participation by users that may have different communication devices and different communication service providers. In addition, in FIG. 1, participants 104 of network 102 may communicate with other participants 114 of other packet networks 110 via gateway 106 and transmission medium 116.

Speech processor 108 of gateway 106 converts voice information of participants 104 of network 102 into a packetized form that can be transmitted to the other packet networks 110. A gateway is a system which may be placed at the edge of the network in a central office or local switch (e.g., one associated with a public branch exchange), or the like. It is noted that in addition to speech encoding and decoding, the gateway performs various functions of receiving and transmitting information (speech samples) from the network 102, and receiving and transmitting information (speech packets) from the packet network (e.g., padding and stripping header information). The gateway also performs data (modem, fax) transmission and receiving functionalities. It will be appreciated that the present invention can be implemented in conjunction with a variety of gateway designs. A corresponding gateway and a speech processor (not shown) might also be associated with each of the other networks 110, and their operation is substantially the same manner as described herein for gateway 106 and speech processor 108 for encoding speech information into packet data for transmission to other packet networks. It is also possible that participants 114 generate packetized speech, where no gateway or additional speech processing is needed for the communication of participants 114 to the networks 110.

Speech processor 108 of the present invention is capable of interfacing with a plurality of communication channels (e.g., 1 through n channels) via communication lines 112 for receiving speech signals as well as control signals in network 102. For example, speech signals from participants 104 are communicated via an appropriate channel for processing by speech processor 108 as described in further detail below. The output of speech processor 108 is then communicated by gateway 106 to the appropriate destination packet network.

Figure 2:
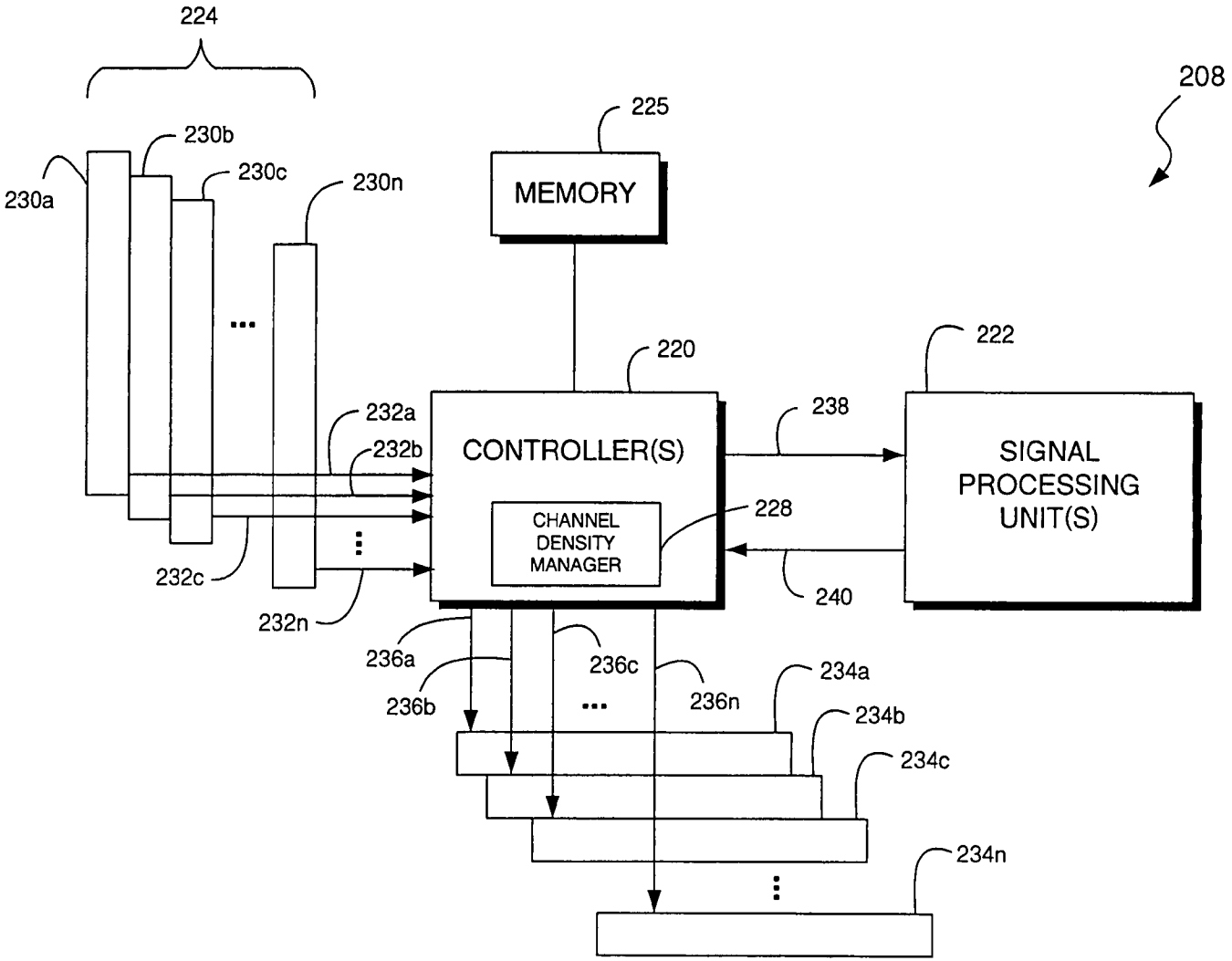
FIG. 2 illustrates a block diagram of an exemplary multi-channel speech processor in accordance with one embodiment.

Referring now to FIG. 2, a block diagram of exemplary multi-channel speech processor 208, in accordance with one embodiment of the present invention, is shown. As described more fully below, multi-channel speech processor 208 provides increased processing efficiency and increased channel density while meeting quality of service ("QoS") requirements. Multi-channel speech processor 208 corresponds to speech processor 108 of FIG. 1, and comprises at least one controller 220 executing a channel density manager ("CDM") 228. The controller 220 is coupled for communication to one or more signal processing units (SPU) 222. Controller 220 receives input speech signal frames 230*a*, 230*b*, 230*c* and 230*n* corresponding to channels 224 via input lines 232*a*, 232*b*, 232*c* and 232*n*, respectively, and generates encoded speech packets 234*a*, 234*b*, 234*c* and 234*n* via output lines 236*a*, 236*b*, 236*c* and 236*n*, respectively.

Controller 220 comprises a processor, such as an ARM® microprocessor, for example. In certain embodiments, a plurality of controllers 220 may be used to enhance multi-channel speech processor's 208 performance. Similarly, a plurality of SPUs 222 may be used to provide increased performance and/or channel density of multi-channel speech processor 208.

Memory 225 stores information accessed by controller 220. In particular, memory 225 stores speech processing time values which are used to calculate whether a maximum execution time has been reached as described more fully below. An illustration for carrying out this calculation is described more fully below in conjunction with FIG. 5. Memory 225 may also be used to store input speech signal data which is processed by SPU 222 as well as the encoded speech packets after processing by SPU 222.

It is noted that the arrangement of multi-channel speech processor 208, as depicted in FIG. 2, is only illustrative and other arrangements for carrying out the operations of CDM 228 are suitable for use with the present invention. For example, a clock of controller 220 may be used to measure the true execution time. In that case, all of the timing information will be produced by controller 220, and not shared in memory 225 with SPU 222. In other embodiments, the operations of CDM 228 may be carried out completely in SPU 222. In yet other arrangements, the operations of CDM 228 may be distributed between controller 220 and SPU 222.

SPU 222 carries out the operation of converting data from input speech signal frames 230*a*, 230*b*, 230*c* and 230*n* of channels 224 into a packetized format using one of the coding rates of a speech codec. For example, SPU 222 may use one of a variable rate codec to convert input speech signal frames 230*a*, 230*b*, 230*c* and 230*n* received from controller 220 via line 238 into encoded speech packets 234*a*, 234*b*, 234*c* and 234*n*, which are transmitted to controller 220 via line 240. Any suitable algorithm may be used for determining which coding rate SPU 222 uses for this encoding process. For example, according to one exemplary implementation, the bit-rate used to code input speech signal frames 230*a*, 230*b*, 230*c* and 230*n* is related to the amount of information carried by input speech signal frames 230*a*, 230*b*, 230*c* and 230*n*.

Figure 3A:
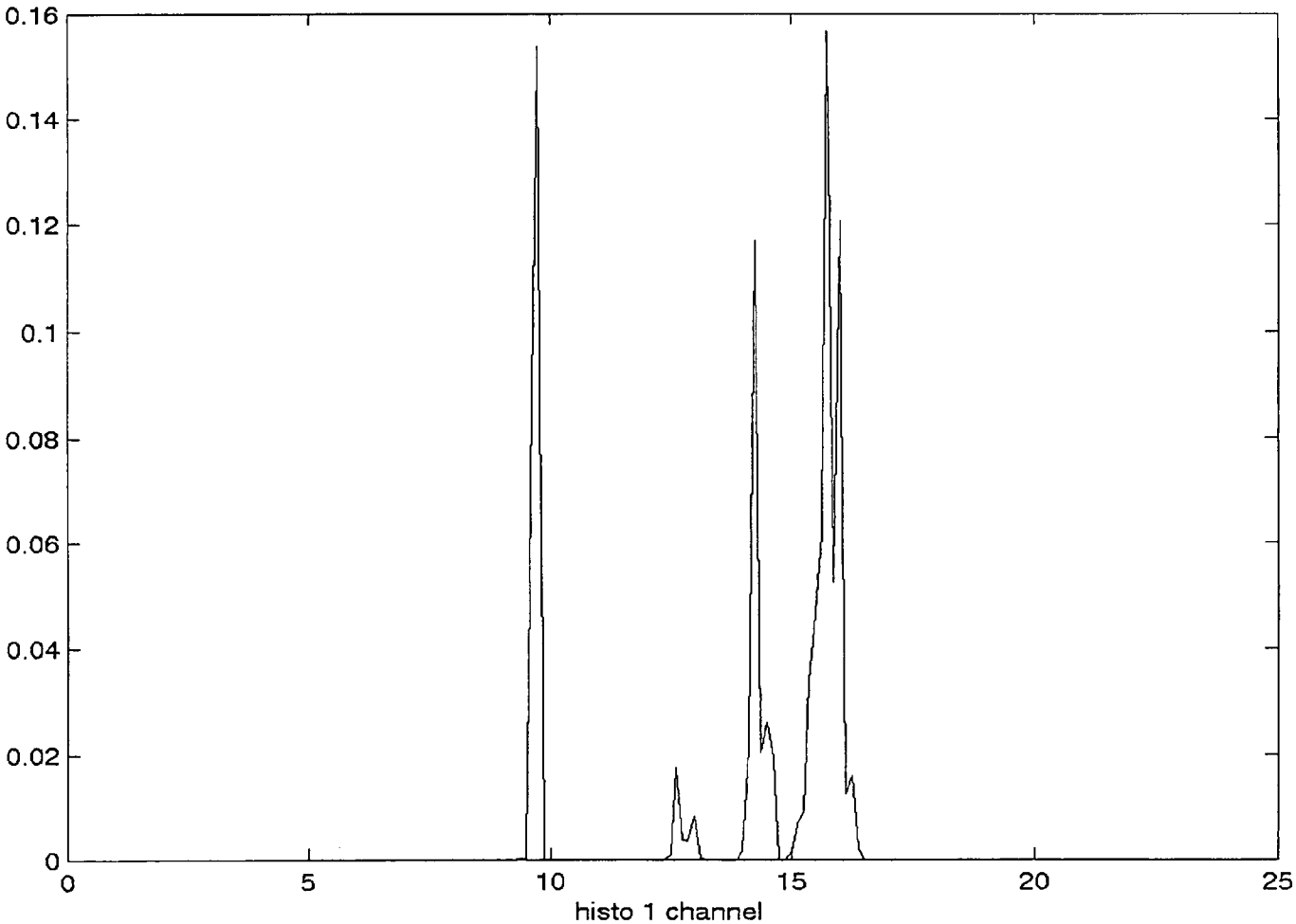
FIG. 3A illustrates an example histogram of a real time trace of MIPS for one channel.
Figure 3B:
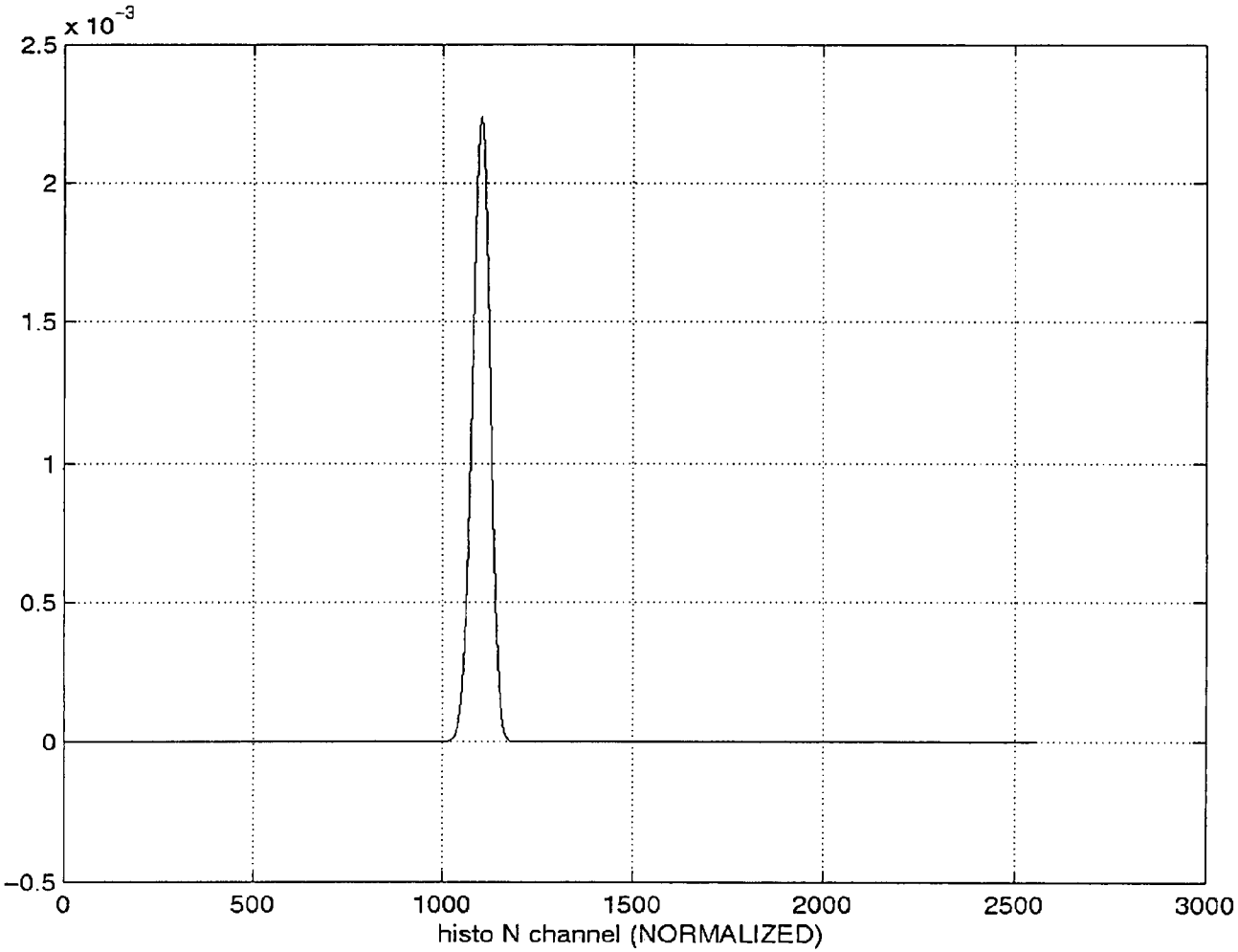
FIG. 3B illustrates an example histogram of a real time trace of MIPS for N channels.

FIG. 3A is an example histogram, which illustrates a real time trace of MIPS for one channel of EVRC (Enhanced Variable rate Coder) and FIG. 3B is an example histogram, which illustrates a real time trace of MIPS for one channel of EVRC, which has been subjected to a convolution with itself for N−1 times (N=80). The trace has been captured using a code that is able to support, in a signal broadcast, only sixty (60) channels. But with the assumption that the channels are independent, the probability of encountering an error is about 4.3135e-07. Referring to FIG. 3B, in the graph N=80, the real time limit of a speech processor at 1200 MIPS is shown in the horizontal axis. In other words, the probability of running out of real time is calculated as the integral from 1200 to the end of the horizontal axis.

Figure 4:
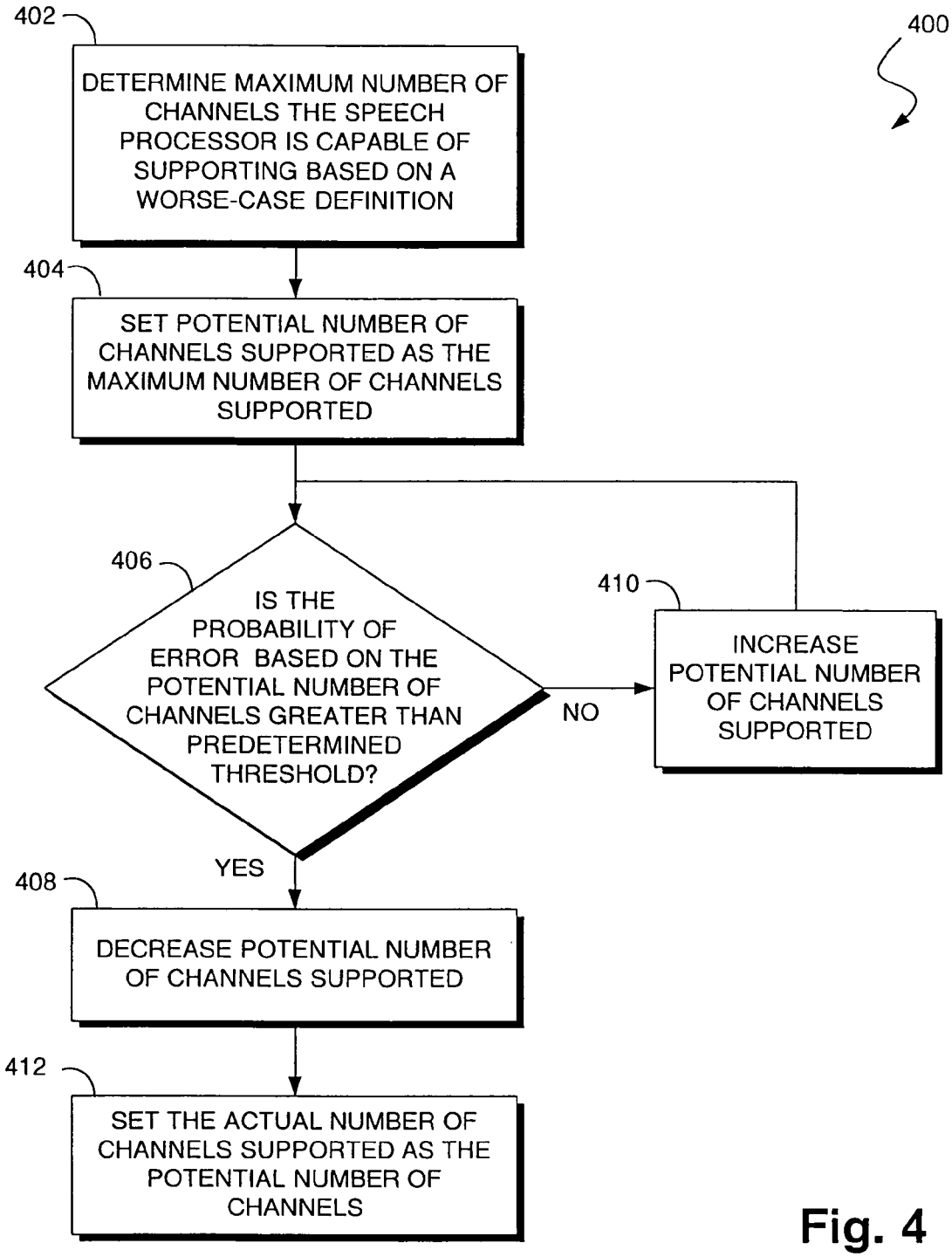
FIG. 4 depicts an illustrative flow diagram of an exemplary method for increasing channel density in a multi-channel speech processor in accordance with one embodiment.

Referring now to FIG. 4, there is shown exemplary flow chart 400 depicting a method for increasing channel density in a speech processor in accordance with one embodiment of the present invention. More particularly, flow chart 400 depicts an exemplary method for calculating an increased number of channels 224 which multi-channel speech processor 208 is capable of supporting while satisfying QoS requirements.

Certain details and features have been left out of flow chart 400 of FIG. 4 that are apparent to a person of ordinary skill in the art. For example, a step may consist of one or more sub-steps or may involve specialized equipment, as known in the art. While steps 402 through 412 shown in flow chart 400 are sufficient to describe one embodiment of the present invention, other embodiments of the invention may utilize steps different from those shown in flow chart 400.

Beginning at step 402, a determination is made as to a maximum number of channels a multi-channel speech processor is capable of supporting based on a worst-case definition. As discussed above, the maximum number of channels supported according to a worst-case definition is calculated by dividing the maximum MIPS (million instructions per second) of the speech processor by the maximum algorithm complexity path. By way of illustration, the maximum number of channels according to a worst-case definition for multi-channel speech processor 208 of FIG. 2 may be sixty (60) channels. At step 404, a potential number of channels supported is initially set to the maximum number of channels supported as calculated from step 402.

At decision step 406, a determination is made as to whether a probability of error based on the potential number of channels supported is greater than a predetermined threshold. This probability of error corresponds to the likelihood that the total complexity of the channels will be higher than the maximum MIPS of the speech processor taking into account that in a multi-channel configuration, the probability that all the channels at a given time require the maximum processing complexity is very low. The predetermined threshold can be set such that the QoS requirements are satisfied for a given application. By way of illustration, a mobile telephone application typically experiences 1–5% frame error rate between a source device and a destination device. In a case where the predetermined threshold is set to less than or equal to the 1–5% frame error rate for a mobile telephone application, customers rarely, if ever, will realize any degradation in QoS. According to another embodiment, the predetermined threshold can be set to a fixed value such as $(10^{-3}/(N-M))$, where N is maximum number of channels that can be processed and M is the number of channels that cannot be processed.

If, at step 406, it is determined that the probability of error based on the potential number of channels supported is greater than the predetermined threshold, step 408 is carried out. Otherwise, the potential number of channels supported is increased at step 410, and decision step 406 is repeated.

At step 408, the potential number of channels supported is decreased by one channel, and at step 412, the actual number of channels supported is set to the adjusted potential number of channels supported. Referring to multi-channel speech processor 208 of FIG. 2, the actual number of channels supported as calculated herein corresponds to the number of channels 224. Whereas the number of channels supported according to a worst case definition may only be limited to 60 channels in certain embodiments, the present invention may provide an actual number of channels supported to be as high as 80 channels, for example.

Thus, a speech processor configured in accordance with flow chart 400 results in significantly improved efficiency, by increasing the channel density supported by the multi-channel speech processor. More particularly, the method for increasing channel density in a multi-channel speech processor as outlined by flow chart 400 takes into account the fact that the probability that all the channels at a given time require the maximum processing complexity is very low. As a result, SPU 222 is "overdriven" by controller 220 such that SPU 222 is able to process additional channels beyond the maximum number of channels supported according to a worst-case definition, thereby allowing SPU 222 to process additional input speech signal frames where otherwise SPU 222 would remain idle. Because the calculation as set forth in flow chart 400 results in a probability of error that is within predetermined thresholds, QoS requirements can be satisfied while supporting a greater number of channels. As a further benefit, the price per port of the multi-channel speech processor configured in this manner is significantly decreased.

Figure 5:
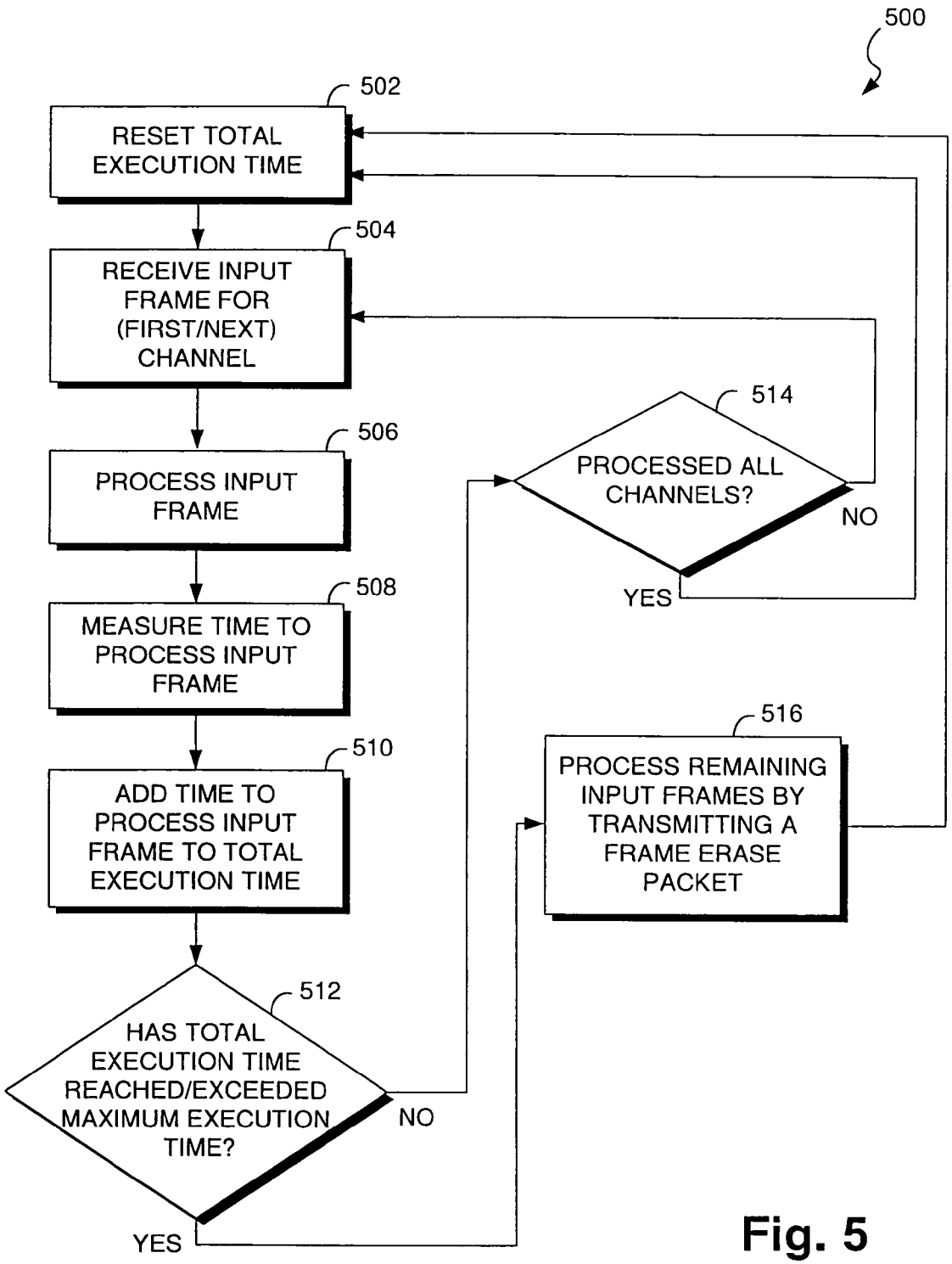
FIG. 5 depicts an illustrative flow diagram of the operation carried out by a channel density manager in accordance with one embodiment.

Referring next to FIG. 5, there is shown flow chart 500 depicting an exemplary operation of CDM 228 executed by controller 220 of FIG. 2 in accordance with one embodiment of the present invention. Certain details and features have been left out of flow chart 500 of FIG. 5 that are apparent to a person of ordinary skill in the art. For example, a step may consist of one or more sub-steps, as known in the art. While steps 502 through 516 shown in flow chart 500 are sufficient to describe one embodiment of the present invention, other embodiments of the invention may utilize steps different from those shown in flow chart 500.

Beginning at step 502, the total execution time is reset by CDM 228. Typically the total execution time is reset during startup or reset, and after processing each set of input speech signal frames 230*a*, 230*b*, 230*c* and 230*n* of channels 224. The total execution time is used to record the amount of time consumed for processing input speech signal frames 230*a*, 230*b*, 230*c* and 230*n* in the current set of frames.

At step 504, CDM 228 receives the first/next input speech signal frame via input line 232*a*, 232*b*, 232*c* or 232*n*. At step 506, the input speech signal frame received during step 504 is transmitted to SPU 222 for processing via line 238. CDM 228 receives the encoded speech packet from SPU 222 via line 240. At step 508, CDM 228 measures the time consumed by SPU 222 to process the input speech signal frame, and transmits the encoded speech packet via respective output line 236*a*, 236*b*, 236*c* or 236*n*.

At step 510, the time to process the input speech signal frame measured during step 508 is added to the total execution time for the current set of frames. At decision step 512, a determination is made as to whether the total execution time for the current set of frames has reached or exceeded the maximum execution time for the multi-channel speech processor. If the total execution time for the current set of frames has reached or exceeded the maximum execution time for the multi-channel speech processor, step 516 is then carried out. Otherwise, decision step 514 is then carried out.

At decision step 514, a determination is made as to whether all input speech signal frames 230*a*, 230*b*, 230*c* and 230*d* of channels 224 have been processed. If not, steps 504 through 512 are repeated for processing the next input speech signal frame. Otherwise, the next set of frames is processed, and step 502 is repeated.

At step 516, the total execution time for the current set of frames has exceeded the maximum execution time for the multi-channel speech processor. This situation may arise, for example, when a large number of high complexity frames were processed in the current set of frames. As discussed above, because the likelihood of this situation occurring is low and within QoS requirements, a certain number of frame errors is determined to be acceptable. As a result, the remaining input speech signal frames in the current set of frames which have not been processed by SPU 222 are not processed by SPU 222. Instead, CDM 228 processes the remaining input speech frames by transmitting a frame erase packet for each of the remaining input speech frames which have not been processed by SPU 222. This frame erase packet is transmitted via corresponding output lines 236*a*, 236*b*, 236*c* and 236*n*, and is formatted so that upon receipt by a destination device, the destination device processes the frame erase packet using conventional frame erase processes, e.g., such as when a frame error occurs during conventional operation. The frame erase packet can be formatted in any manner to achieve this result, including formatting the frame erase packet in way which violates encoding rules, such as an illegal packet or a blank frame, for example. Step 502 is then repeated to process the next set of frames.

In processing each set of frames as described above according to flow chart 500, CDM 228 may further employ an algorithm for determining the order in which frames 230*a*, 230*b*, 230*c* and 230*n* of channels 224 are processed. For examples, CDM 228 may employ a round-robin ordering scheme, e.g., in groups of frames, so that likelihood that the same channel(s) as the previous frame will be processed as a frame erase packet during step 516 is further reduced. In this way, frame erase processing (step 516) can be evenly distributed among channels 224.

The methods and systems presented above may reside in software, hardware, or firmware on the device, which can be implemented on a microprocessor, digital speech processor, application specific IC, or field programmable gate array ("FPGA"), or any combination thereof, without departing from the spirit of the invention. Furthermore, the present invention may be embodied in other specific forms without departing from its spirit or essential characteristics. The described embodiments are to be considered in all respects only as illustrative and not restrictive.

What is claimed is:

1. A method for supporting increased channel density in a multi-channel speech processor, said method comprising:

determining a maximum number of channels that said multi-channel speech processor is capable of supporting based on a worst-case definition; and supporting an actual number of channels using said multi-channel speech processor, wherein said actual number of channels is at least one channel greater than said maximum number of channels if a probability of error for supporting said actual number of channels is less than a predetermined threshold.

2. The method of claim 1, wherein said multi-channel speech processor supports a plurality of bit-rates.

3. The method of claim 1, wherein said probability of error satisfies quality of service requirements.

4. The method of claim 1, wherein said predetermined threshold is less than or equal to a frame-error-rate of a transmission medium used by said multi-channel speech processor.

5. The method of claim 1, wherein said multi-channel speech processor has a maximum execution time for processing all frames, one channel at a time, by processing a single frame from each of said plurality of channels, said method further comprising encoding each of said single frames from each of said plurality of channels, one channel at a time, to generate encoded frames and transmitting said encoded frames, until said maximum execution time elapses or is about to elapse.

6. The method of claim 5, further comprising transmitting a predetermined frame for each of said plurality of channels not processed during said encoding step, due to said maximum execution time elapsing or being about to elapse, such that said predetermined frame causes a decoder which receives said predetermined frame to generate a frame erase frame.

7. The method of claim 6, wherein said predetermined frame is a frame erase packet.

8. The method of claim 6, wherein said predetermined frame an illegal packet.

9. The method of claim 6, wherein said predetermined frame is a blank frame.

10. A multi-channel speech processor comprising:

a controller capable of interfacing with a plurality of channels;

a memory coupled to said controller configured to store speech signal process time values; and at least one signal processing unit (SPU) coupled to said controller, said SPU configured to encode input speech signal frames received via said plurality of channels, wherein said plurality of channels comprises an actual number of channels, and wherein said actual number of channels is at least one channel greater than a maximum number of channels according to a worst-case definition if a probability of error for supporting said actual number of channels is less than a predetermined threshold.

11. The multi-channel speech processor of claim 10, wherein said multi-channel speech processor supports a plurality of bit-rates.

12. The multi-channel speech processor of claim 10, wherein said probability of error satisfies quality of service requirements.

13. The multi-channel speech processor of claim 10, wherein said predetermined threshold is less than or equal to a frame-error-rate of a transmission medium used by said multi-channel speech processor.

14. The multi-channel speech processor of claim 10, wherein said multi-channel speech processor has a maximum execution time for processing all frames, one channel at a time, by processing a single frame from each of said plurality of channels, wherein said SPU is configured to encode each of said single frames from each of said plurality of channels, one channel at a time, to generate encoded frames until said maximum execution time elapses or is about to elapse.

15. The multi-channel speech processor of claim 14, wherein said controller is configured to transmit said encoded frames, said controller further configured to transmit a pre-determined frame for each of said plurality of channels not processed during said encoding step, due to said maximum execution time elapsing or being about to elapse, such that said predetermined frame causes a decoder which receives said predetermined frame to generate a frame erase frame.

16. The multi-channel speech processor of claim 15, wherein said predetermined frame is a frame erase packet.

17. The multi-channel speech processor of claim 15, wherein said predetermined frame is an illegal packet.

18. The multi-channel speech processor of claim 15, wherein said predetermined frame is a blank frame.

* * * * *